United States Patent [19]

Mueller

[11] Patent Number: 4,621,804

[45] Date of Patent: Nov. 11, 1986

[54] THERAPEUTIC ROLLER/WALKER

[75] Inventor: Robin R. Mueller, Scottsdale, Ariz.

[73] Assignee: R-Jayco Ltd., Scottsdale, Ariz.

[21] Appl. No.: 715,910

[22] Filed: Mar. 25, 1985

[51] Int. Cl.[4] ..... A47D 13/04

[52] U.S. Cl. ..... 272/70.3; 280/43.23; 280/87.02 W; 297/6; 16/33; 135/67

[58] Field of Search ..... 135/67; 272/70.3, 70.4, 272/70; 280/87.02 W, 87.02 R, 87.04 R, 7.17; 297/4, 5, 6, 45, 441, 443, 445, 457, 458, 459; D3/7, 8; D6/333, 334, 335, 340, 342, 344, 347, 354, 363, 367, 368; 5/122, 123; 16/24, 32, 33

[56] References Cited

U.S. PATENT DOCUMENTS

| | | | |
|---|---|---|---|
| 116,073 | 6/1871 | Maschmann | 280/87.02 W |
| 320,462 | 6/1885 | Cowing | 272/70.3 |
| 1,092,808 | 4/1914 | Culver | 16/33 |
| 1,361,102 | 12/1920 | Scott | 272/70.4 |
| 1,890,396 | 12/1932 | Maphet | 297/5 |
| 2,176,551 | 10/1939 | Solem | 16/33 X |
| 2,224,246 | 12/1940 | Ames | 297/6 |
| 2,278,901 | 4/1942 | Smock | 272/70.4 |
| 2,305,249 | 12/1942 | Frost | 297/6 |
| 2,316,100 | 4/1943 | Nelson | 297/5 X |
| 2,437,778 | 3/1948 | Ames | 297/6 |
| 2,459,066 | 1/1949 | Duke | 297/5 |
| 2,733,754 | 2/1956 | Leslie | 297/6 |
| 2,759,525 | 8/1956 | Ries | 135/67 |
| 2,798,533 | 7/1957 | Frank | 297/6 |
| 3,354,893 | 11/1967 | Schmerl | 135/67 |
| 3,455,313 | 7/1969 | King | 135/67 |
| 3,488,088 | 1/1970 | Goldberg | 297/5 |
| 3,778,052 | 12/1973 | Andow | 272/70.4 |
| 3,993,349 | 11/1976 | Neufeld | 297/6 |
| 4,212,493 | 7/1980 | Ledesky | 135/67 X |
| 4,312,505 | 1/1982 | Engelhart | 272/70.3 |
| 4,342,465 | 8/1982 | Stillings | 280/87.02 |

FOREIGN PATENT DOCUMENTS

| | | | |
|---|---|---|---|
| 1330189 | 5/1963 | France | 272/70.3 |
| 365504 | 12/1962 | Switzerland | 280/87.02 W |

*Primary Examiner*—Richard J. Johnson

*Attorney, Agent, or Firm*—LaValle D. Ptak

[57] ABSTRACT

A therapeutic walker has features which permit its use by persons with varying degrees of disability and is capable of adaptation to be used in different ways as the level of disability diminishes. A walker frame extends substantially around three sides of the region occupied by person using the walker and a removable closure bar is attached across the frame on its open side. An elongated crotch-cradling panel of flexible material is removably attached between the closure bar and the frame on the opposite side of the walker. The person using the walker straddles the crotch-cradling panel which is adjustable in length for persons of different sizes. The legs of the walker are adjustable in height and terminate in removable or retractable casters. A person using the walker can either sit down on the seat or stand up in the walker (with appropriate adjustments being made in the length of the legs). In more severe cases of disability, the caster wheels are employed and the seat acts as a safety feature if the person using the walker should stumble or fall, since it will catch the person and prevent or minimize injury. For persons with less disability, the seat may be removed and the casters may be removed or retracted; so that the walker can be used in a conventional manner.

23 Claims, 9 Drawing Figures

THERAPEUTIC ROLLER/WALKER

BACKGROUND OF THE INVENTION

Walkers have been used for many years by elderly persons who are somewhat feeble to assist them in walking unattended and to protect them against falling. Such walkers also have been utilized by physically handicapped persons and convalescent patients who are undergoing rehabilitation from long periods during which they were bed-ridden. The standard walker comprises a metal frame with a front portion and rearwardly-extending side portions forming hand grips at a convenient height for the person using the walker. Usually the frame has four legs extending from it. In use, a person moves ahead by picking up the walker frame and moving it ahead a short distance. A step or two then is taken and the process is repeated, with the walker supporting the weight of the person during the times that steps are being taken. Such walkers, however, are not capable of use by more seriously physically handicapped persons and convalescent patients requiring substantial partial or almost total support during the walking process.

Various attempts have been made in the past to provide a walker which is capable of utilization by more severely handicapped or convalescent patients. One such walker, which is usable through various stages of rehabilitation, is disclosed in the patent to Andow, U.S. Pat. No. 3,778,052. This walker comprises a wheeled support structure which defines an open framework enclosure extending at or above the head of the person using it. The enclosure includes an adjustable height crotch sling and belt assembly which is suspended from the upper from (over the head). This assembly is attached to the handicapped person or convalescent patient. Opposite side rails defining hand rails, comparable to conventional walker hand rails, also are provided, and these hand rails may be gripped by the person using the walker. In addition, the walker includes adjustable crutch heads for positioning beneath the armpits of the person using the walker. The legs of the walker are provided with casters, so that it readily rolls from place to place. The structure of the walker of the Andow Patent is large and cumbersome. In addition, the crotch sling support mechanism is somewhat unstable since it is suspended from a point over the head of the person using the walker. Consequently, if that person should fall, there is a possibility that the walker might tip over. The crotch sling apparatus of the Andow walker also involves a large number of straps and hooks causing it to be expensive and difficult to adjust and put on.

Another approach to a safety walker, incorporating some of the features of the Andow walker, is disclosed in the patent to Stillings, U.S. Pat. No. 4,342,465. This walker resembles the walkers used by toddlers who are just beginning to learn to walk. The height of the Stillings walker is more of a conventional walker height than the one disclosed in the Andow Patent. The walker of Stillings has a framework which is in two sections hinged together at one side. The sections can be opened with respect to one another to admit entry of a handicapped person. After entry of the handicapped person, the hinged sections are rigidly locked together. A vertically adjustable seat is supported within the framework adjacent the rear portion and a number of legs are provided, terminating in casters to permit the walker to be rolled along a surface. Once the handicapped person is located in the walker, a cushioned support cord is extended from the front of the seat and is attached to the front portion of the framework. This support cord functions as a saddle to partially support the weight of the person using the walker if that person stumbles and begins to fall while utilizing the walker. The support bars for the seat, however, may interfere with the normal walking motion of a person using the walker if the person does not stand close to the front of the walker during use. This interference could result in inhibiting the use of the walker by handicapped persons. In addition, the hard seat does not provide protection against falls to the rear in the event the handicapped person should lose his or her balance and fall backward.

Another approach to providing a walker for convalescing patients or relatively severely handicapped patients is disclosed in the patent to Duke, U.S. Pat. No. 2,459,066. This patent has a three-sided walker frame of generally standard configuration. The legs, however, terminate in caster wheels. An adjustable bar, provided with a cushioned saddle 18, extends from the front of the walker between the legs of the person using it. This bar may be adjusted to a location sufficient to support part of the weight of the person using the walker or to a position where it does not support any weight but where it is available in case the person using the walker becomes tired or should stumble and being to fall. Auxiliary crutches also are provided for adjustment under the armpits of the user to also support part of the weight of the user during use of the device. The device of Duke does not subject the user to the cross bars which are present in the Stillings Patent; but the crotch support member of Duke does not provide side-to-side freedom of movement because it is rigid. The Duke device also has a low center of gravity so that it is not subject to the instability of the Andow apparatus but, if a person using the walker of Duke should tend to fall backward, the open back of the walker provides no safety whatsoever.

The patent to Goldberg, et al, U.S. Pat. No. 3,488,088, discloses a rolling seat type of walker apparatus utilizing a bicycle seat mounted within an otherwise standard walker provided with caster wheels on its legs. The device of Goldberg is intended to provide ambulatory exercise aid to a patient, but it is not intended to permit the patient to stand up or load his legs. Goldberg is subject to a difficulty in mounting and dismounting since the seat is more or less permanently located in the center of the walker at its pre-adjusted height. The person using the walker must approach it from the rear and straddle the seat and then sit down on it before it is capable of being used.

In addition to the foregoing therapeutic walkers utilizing rollers and various types of full or partial support for persons using the walker, invalid walkers have been provided with seats for use during times when the person using the walker becomes tired or needs to rest. Typical of devices of this type is the one disclosed in the patent to Frank, U.S. Pat. No. 2,798,533. This patent employs a fold-down seat in an otherwise standard walker. Normally, the seat is moved up out of the way and the walker is used in its normal fashion. When the person using the walker, however, becomes tired, the seat may be pulled downward to rest on a support bar provided for that purpose. The person using the walker then simply turns around and sits down on the seat to rest. A number of variations of this type of combined walker/chair have been provided in the past. The seat, however, is not used during the time the walker is employed to assist a patient in moving from one point to another. When the seat is down, the walker is used as a chair in a permanent location.

It is desirable to provide a simple, safe and easy-to-use therapeutic device, which is capable of use during the recovery of a convalescent patient during different stages, beginning with the requirement of considerable support and progressing through stages of lesser support.

SUMMARY OF THE INVENTION

Accordingly, it is an object of this invention to provide an improved therapeutic walker.

It is another object of this invention to provide an improved therapeutic roller/walker capable of being used safely by a person subject to falling.

It is an additional object of this invention to provide an improved therapeutic roller/walker capable of catching the weight of a person using it who begins to fall within the framework of the walker.

It is a further object of this invention to provide an improved therapeutic roller/walker of stable comfiguration and which readily is configured in different ways as the strength of a convalescing patient improves.

In accordance with a preferred embodiment of this invention, a therapeutic walker includes a frame which extends around at least three sides of the region occupied by a person using the walker. A closure bar is movably attached to the frame to selectively close the fourth side of the region occupied by the person using the walker. An elongated crotch-cradling panel of flexible material is attached between the movable closure bar and the portion of the frame which is diametrically opposite the closure bar, so that the panel is draped in a generally U-shaped configuration. This panel is removably attached at at least one end to permit it to be secured in place after the person using the walker enters the region surrounded by the frame. Legs are attached to the frame at spaced locations to maintain it at a desired distance above the surface on which the walker is used.

DETAILED DESCRIPTION

Figure 1:
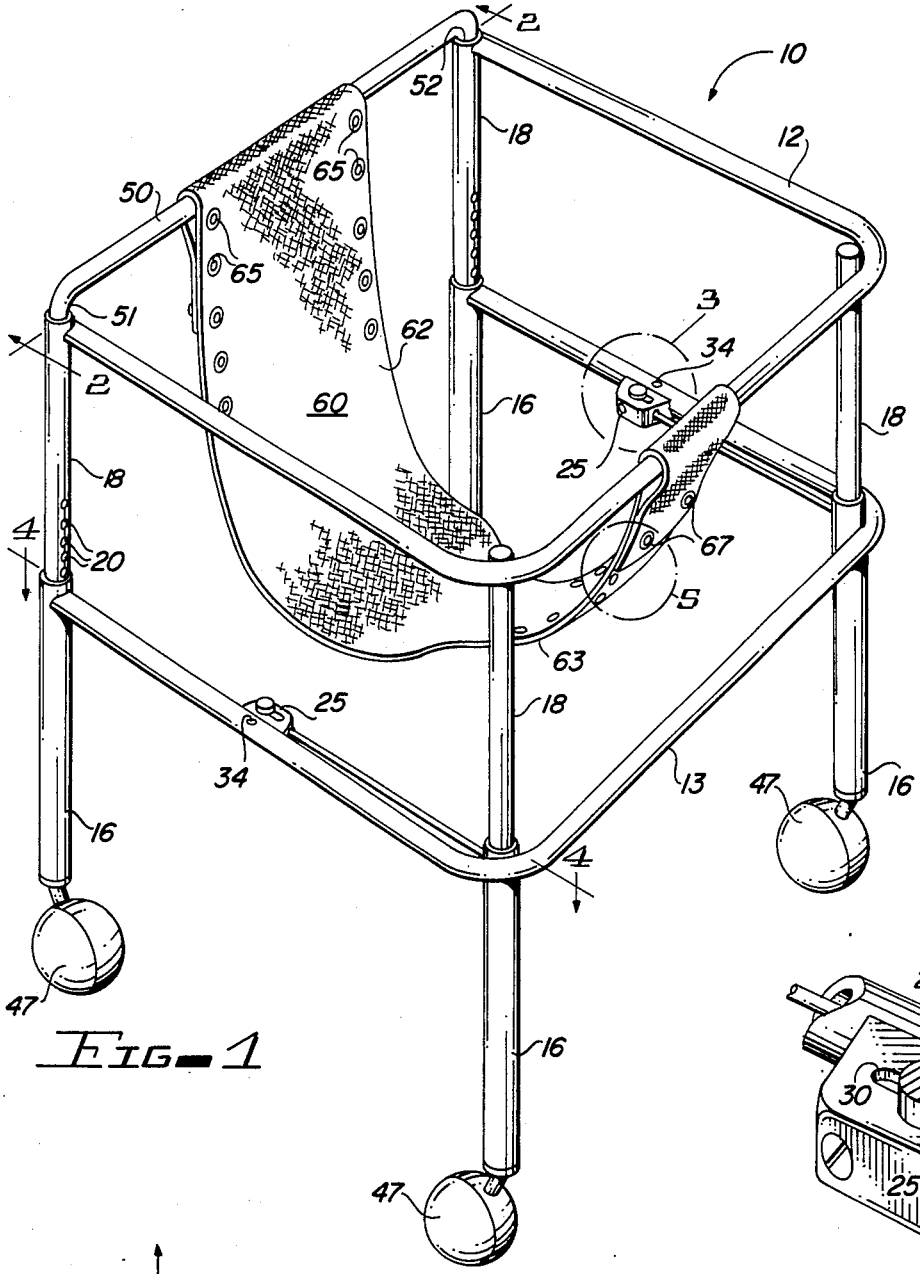
FIG. 1 is a perspective view of a preferred embodiment of the invention.

Reference now should be made to the drawings in which the same reference numbers are used throughout the different figures to designate the same or similar components. Initially, reference should be made to FIG. 1 which illustrates the roller/walker of a preferred embodiment of the invention in the configuration it takes when it is used by a convalescent patient. The roller/walker 10 shown in FIG. 1 includes upper and lower horizontal tubular frame members 12 and 13 which extend across the front and toward the rear along both sides of the roller/walker. In FIG. 1 these frame members 12 and 13 are shaped to provide an open rectangular configuration, with the opening located at the rear of the walker. Each of the four corners of the rectangle thus formed is provided with vertical legs, having lower portions 16 attached to the frame member 13 and upper portions 18 which telescope into the lower portions 16. The upper portions 18 are connected to the upper frame member 12.

Each of the upper leg portions 18 has a series of spaced vertical holes located in it. These holes face toward one another and vertical adjustment of the top frame member 12 with respect to the bottom frame member 13 is effected by means of a slide lock lever mechanism 25 mounted on the side portions of the lower frame member 13. The details of this slide lock mechanism 25 are shown most clearly in FIGS. 3 and 4. The mechanism 25 mounts over an aperture 27 formed in the inward facing side of the side rail portions of the frame member 13. This is shown most clearly in FIG. 4. A thumb-operated slide button 28 is mounted on the top of each mechanisms 20 to move forward and rearward in a slot 30, shown most clearly in FIG. 3. The button 28 includes an extension attached pivotally to one end of a pivoted lever rod 32 which extends through the slot 27 and pivots about a pin 34 secured in the hollow frame member 13, as shown most clearly in FIG. 4.

Movement of the slide button 28 toward the rear (toward the left in FIG. 1) causes the lever 32 to rotate about the pin 34 to withdraw an internal rod 40 and an external rod 41 out of engagement with corresponding holes 20 in the upper leg portions 18 of the front and rear legs associated with each of the devices 25. Thus, movement of the slide buttons 28 in both of the mechanisms 25 to the rear releases the upper frame member 12 of the roller/walker of FIG. 1, so that it may be adjusted upwardly or downwardly to the desired height above the member 13 and, consequently, above the floor on which the roller/walker 10 is to be used.

Figure 3:
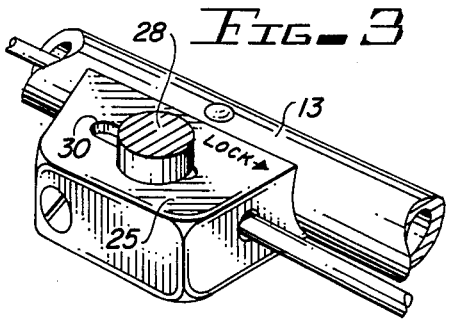
Figure 2:
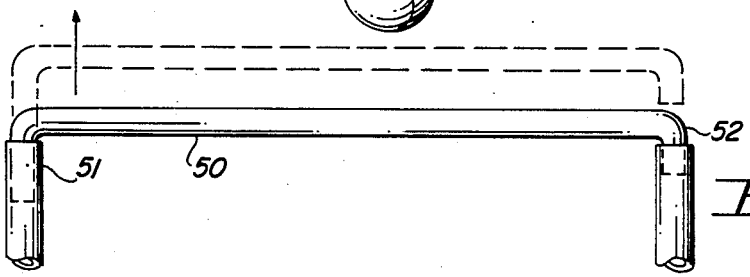
FIG. 2 shows details of a portion of the embodiment of FIG. 1.
Figure 4:
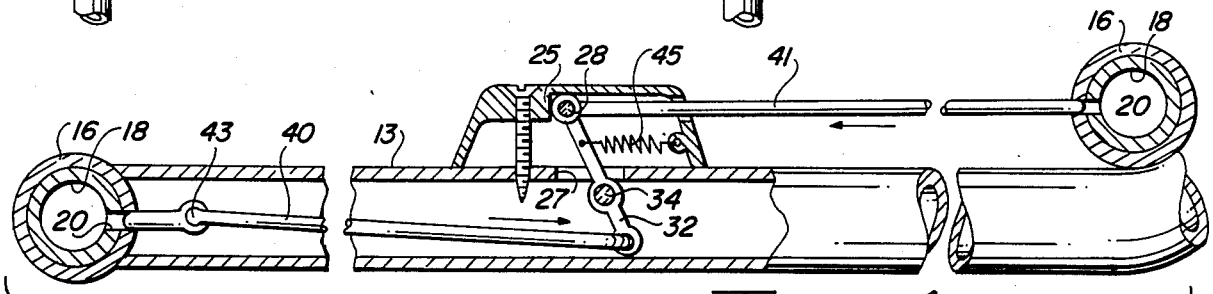

When the proper height is obtained, the slide buttons 28 are moved to the front of the apparatus (to the right as shown in FIGS. 1, 2 and 3). This causes the lever arms 40 and 41 to extend into the holes 20 of the associated leg members 18 to secure the legs in place by means of the ends of the rods 40 and 41. Because of the off-center location of the rod 40 within the member 13, a simple hinge 43 is provided near the end of the rod 40 where it enters the hole 20 in the leg 18 to insure that no binding takes place.

A coil spring 45 is provided to bias the lever 32 about the pivot pin 34 in a direction to cause the ends of the rods 41 and 40 to be forced into engagement with the corresponding holes 20 in the legs 18. This is a "fail-safe" feature of the locking mechanism. Obviously, other types of locking devices for telescoping legs may be employed, if desired. The one illustrated in FIGS. 1, 3 and 4, however, is easy to use and permits sure and rapid adjustment of the vertical height of the frame member 12 relative to the floor. It also provides secure locking of the upper portion of the roller/walker to the lower portion when it is in use.

The lower ends of each of the leg members 16 are terminated in a ball type caster 47 which may be of a conventional design. Thus, the walker easily rolls in any direction under the control of a person using it.

Figure 6:
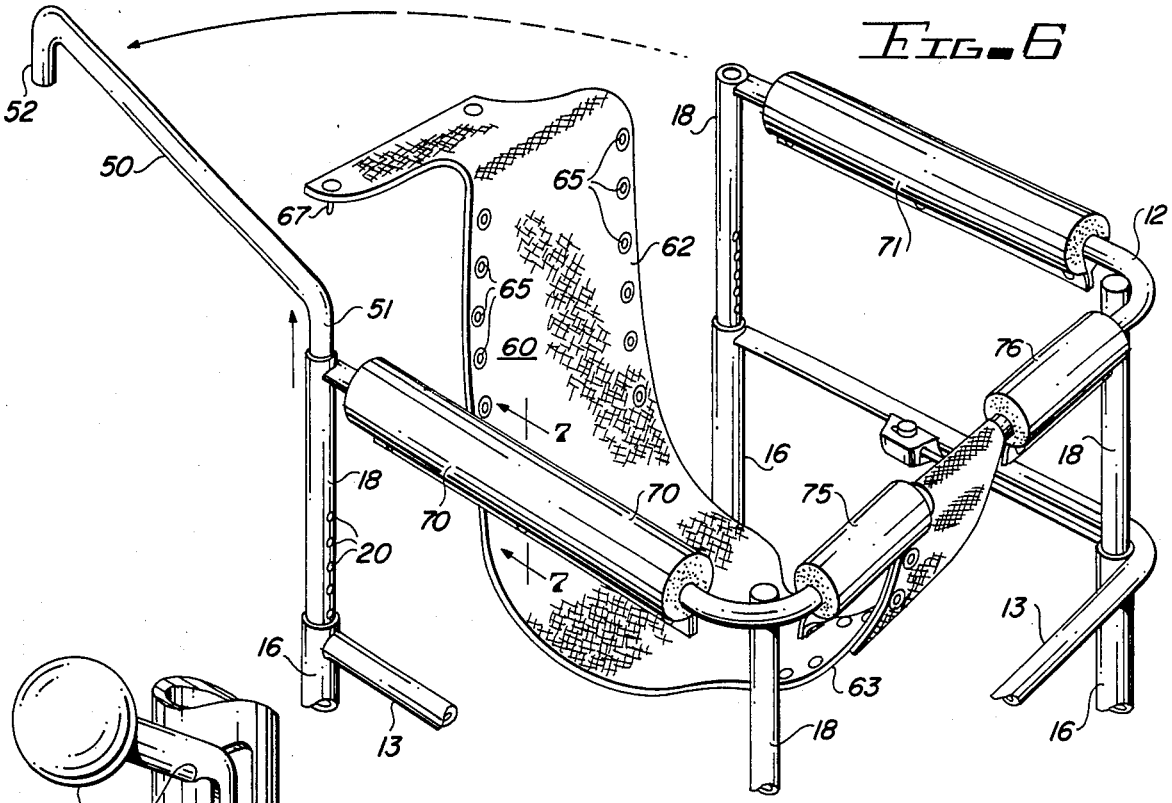
FIG. 6 is a perspective view illustrating different features of the operation of the embodiment shown in FIG. 1.

Since the roller/walker 10 may be used by persons in early stages of physical rehabilitation, where such persons may be wholly incapable of supporting their own weight or capable of supporting their own weight only for short periods of time, the additional features of the roller/walker of FIG. 1 which are illustrated have been provided. The upper ends of both of the rear legs 18 are open. Since hollow tubular material is used to form these legs, an elongated closing bar 50, with downwardly turned ends 51 and 52, is readily inserted into the open ends of the legs 18 to securely form a fourth side to the open rectangle of the top frame member 12. The closing bar 50 may be completely removed from the roller/walker, but in most cases it is preferable to simply pivot it to one side, as illustrated most clearly in FIG. 6, to permit ingress and egress to the interior space of the roller/walker 10 by the patient. To most simply accomplish this, the downwardly-turned end 51 of the bar 50 is longer than the end 52, as illustrated in FIGS. 2 and 6. Thus, the bar may be lifted up sufficiently for the end 52 to clear the top of the leg 18 into which it is inserted. At the same time, the end 51 still remains inside the leg 18 with which it is associated; so that the bar 50 may be pivoted toward and away from the opposite leg 18, as illustrated most clearly in FIG. 6.

To provide a significant degree of support and safety for a person undergoing rehabilitative walking, an elongated crotch-cradling panel 60 made of flexible material is attached between the closure bar 50 and the front portion of the upper frame member 12 to drape downwardly in a generally U-shaped configuration, as illustrated most clearly in FIG. 1. The panel 60 has a wider portion 62 extending essentially from its center toward the rear, where it is attached to the bar 50, and a narrower portion 63 extending essentially from the midpoint to the front where it is attached to the front portion of the frame member 12. This again is illustrated most clearly in FIGS. 1 and 6.

To make it as simple as possible for a patient to enter the roller/walker 12 and to exit from the roller/walker 12, the crotch-cradling panel 60 is made removable from at least the closure bar 50, as indicated in FIG. 6. To use the device, the panel 60 is loosened; and the bar 50 is rotated to the position shown in FIG. 6. The panel 60 obviously will drop to the ground, and it is suspended at its front end over the top of the front portion of the frame member 12. The person who is then going to use the roller/walker steps into or is assisted into a standing position within the region defined by the frame members 12 and 13, facing the right as shown in FIGS. 1 and 6. The bar 50 then is rotated clockwise (as shown in FIG. 6) to the position shown in FIG. 1 and the end 52 is inserted into the top of the leg 18 with which it is associated.

Figure 5:
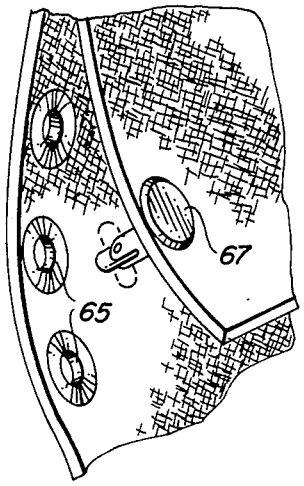
FIGS. 3, 4 and 5 illustrate additional details of various portions of the embodiment of FIG. 1.

The panel 60 then is pulled between the legs of the person in the walker and the rear portion 62 is pulled up over the top of the bar 50, wrapped behind it, and is fastened in one of a suitable number of metal reinforced fastening holes 65, formed in parallel rows on opposite sides of the portion 62 by means of a swivel pin fastener 67 (one of which is shown in detail in FIG. 5). It is apparent that adjustment of the panel 60 with respect to the patient who is going to use the roller/walker readily is effected by selecting an appropriate one of the holes 65 on each side of the portion 62 of the panel 60 for engagement by the fastener 67. Similar adjustments may be made on the front portion of the panel 60 to position the wide and narrow portions of the panel 60 precisely where desired with respect to any particular patient and also to effect the exact vertical adjustment of the panel 60 which is desired for the use by the patient.

Once the patient is located within the roller/walker 10, he or she may use the side portions of the upper rail 12 as hand rails or a steadying device to move the walker. In initial stages of therapy, or for handicapped persons, the patient or handicapped person is actually seated on the panel 60 and moves the walker about by moving his or her feet against the floor to cause the roller/walker 10 to roll on the casters 47.

For stronger patients, where the patient's legs are capable of supporting at least some of his or her weight, the arrangement shown in FIG. 1 still may be used. The panel 60, however, is adjusted to a position just slightly below the crotch of the patient when the patient is standing. The patient then can move about, using the walker as a support. In the event the patient should become tired or should falter and begin to fall, the panel 60 acts as a seat to catch the fall or permit the patient to rest as desired. The panel 60 is always available as a seat; but during times when the roller/walker is being used by a walking patient, it is not functioning but merely acts as a safety backup. Since the portion 63 at the front of the panel 60 is narrower than the portion 62 at the rear, adjustment of the relative fastening positions of both the front and rear parts of the panel can be effected to cause it to be most comfortable in use when a patient is walking with the safety panel 60 in place.

Figure 7:
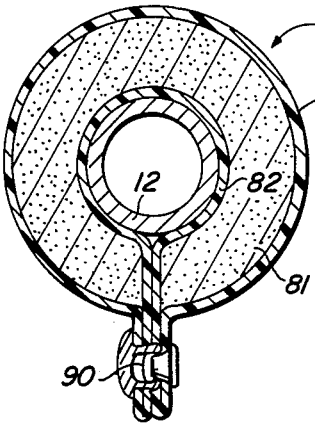
FIG. 7 is a cross-sectional view taken along the line 7—7 of FIG. 6.

FIGS. 6 and 7 illustrate additional features which may be utilized, particularly for patients who are quite weak. It may be desirable to provide pads 70 and 71 over the side rail portions of the frame member 12 and comparable pads 75 and 76 on each side of the region where the end 63 of the panel 60 extends over and is fastened over the frame member 12. These pads are illustrated in FIG. 6 and a detail is shown of one of the pads in FIG. 7. The pad 70, for example, has an outer layer of suitable smooth protective material 80. the interior is formed of a foam pad cylinder 81, and the interior of the cylinder also is covered with a protective layer 82. The inner and outer layers 80 and 82 are extended downwardly beneath the rail 12 (as shown most clearly in FIG. 7) and are snapped together by means of conventional snap fasteners 90. If the pads 70, 71, 75 and 76 are not desired, it is a simple task to remove them leaving the rail member 12 uncovered as shown in FIG. 1. To prevent the pads 70, 71, 75 and 76 from turning on the member 12, Velcro strips or the like may be attached to the member 12 and the facing surface of the inner layer 82 of the pads.

As the patient progresses in strength, a point ultimately will be reached where the caster rollers 47 are not necessary to provide forward motion and where the roller/walker 10 may be used as a more conventional walker. To accomplish this purpose two different alternative structures may be employed. These are illustrated in FIGS. 8 and 9.

Figure 8:
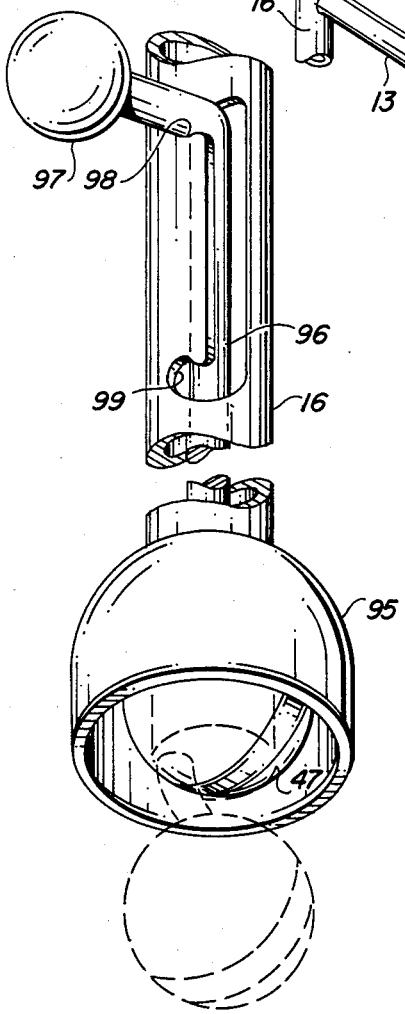
FIGS. 8 and 9 illustrate different alternatives which may be utilized for one of the features of the embodiment shown in FIG. 1.

In FIG. 8, the lower end of the leg 16 is shown as terminating in an outwardly flared, inverted bell-shaped member 95. The caster 47 then is attached to an elongated rod 96 which terminates in a lever 97. This lever 97 extends out of a vertical groove formed through the leg member 16. This groove terminates in circumferentially turned notches 98 and 99 at its upper and lower ends, respectively. When the portion of the rod 96 which extends out of the groove is turned to engage the lower notch 99, the caster 47 is in the dotted line position shown in FIG. 8. This also is the position illustrated in FIG. 1 for utilization of the casters 47 to roll the roller/walker 10 from point to point. In the position shown in solid lines in FIG. 8, with the rod 96 engaging the notch 98, the caster 47 is withdrawn into the bell housing 95 to clear the bottom of the bell housing 96; so that it is in a retracted position. In this position, the roller/walker may be used in a conventional manner to move it on a step-by-step basis as the person using it lifts it, moves it, and then walks.

Figure 9:
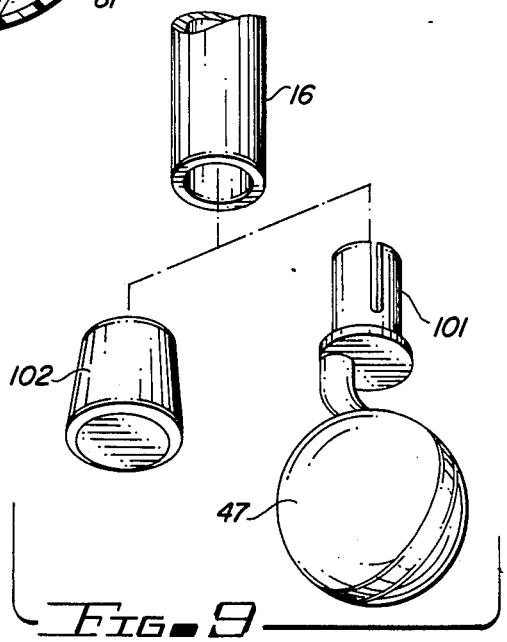

An alternative to the arrangement of FIG. 8, and one which is more simple in structure, is illustrated in FIG. 9. Here a conventional caster 47 is attached to a plug member 101 which is inserted into the open lower end of the leg 16 when the caster 47 is to be used. When the roller/walker 10 is to be used as a more or less standard walker, the caster 47 and plug 101 to which it is attached are removed; and a rubber or neoprene tip 102 is placed over the end of the leg 16. This tip may be of the type commonly used on the ends of crutches, walkers and canes and is readily available.

It also is apparent that when a patient has progressed to the point that the device is being used as a standard walker, the closure bar 50 and the panel 60 no longer are necessary. Consequently, these may be easily removed and stored for subsequent use. The walker then may be used in the manner of a standard walker.

The invention, which has been described, is a multipurpose therapeutic tool which is capable of being used by persons barely able to move their legs; and by persons nearly capable of walking completely unaided. It is not necessary to purchase different types of therapeutic devices in order to handle the progression of the patient's increasing strength through these different stages of recovery. The single roller/walker device 10 which has been descrcibed is capable of handling all of these different phases or aspects of the patient's recovery.

The foregoing description of the preferred embodiment is to be considered as illustrative only of the invention and not as limiting. Various modifications and changes will occur to those skilled in the art without departing from the true scope of the invention. For example, the manner in which the vertical legs are telescoped into one another and locked into place can be accomplished in a variety of different ways. Similarly, the particularly structure of the closure bar and the manner in which it is inserted into and pivots to permit ingress and egress from the space defined by the interior of the roller/walker may be varied. A bar which is permanently hinged to one of the vertical legs may be utilized. It is possible to use a bar which pivots upwardly instead of in a horizontal plane. Similarly, variations may be made in the structure and manner of fastening the panel 60 to the upper frame member 12. Obviously, the rectangular configuration may be modified to a round one, if desired. Other changes also will occur to those skilled in the art without departing from the scope of the invention.

I claim:

1. A therapeutic walker particularly suitable for use by persons with varying degrees of disability during the progress of rehabilitation including in combination:

a frame extending around at least three sides of a region occupied by a person using the walker, said frame functioning as hand rails for such person;

a closure bar movably attached to said frame to selectively close the fourth side of the region occupied by a person using the walker;

an elongated crotch-cradling panel of flexible material, attached between opposite sides of said frame to be draped in a generally U-shaped configuration and adapted to pass entirely between the legs of a person using said walker, said panel being removably attached at at least one end thereof, said crotch-cradling panel functioning as a seat located substantially in the center of the region within said frame; and a plurality of legs attached at spaced locations to said frame and extending downwardly therefrom for supporting said frame on the surface on which the walker is used.

2. The combination according to claim 1 wherein a caster is attached to the lower end of each of said legs.

3. The combination according to claim 2 wherein said casters are removably attached to the lower ends of said legs.

4. The combination according to claim 2 wherein said casters are retractably attached to the lower end of said legs.

5. The combination according to claim 2 wherein said frame comprises three sides of a rectangle, and is horizontally oriented when said walker is in use.

6. The combination according to claim 5 wherein said closure bar is removably attached to the open fourth side of said rectangle.

7. The combination according to claim 6 wherein said crotch-cradling panel is attached at its forward end to said frame and at its rearward end to said closure bar.

8. The combination according to claim 7 wherein the manner of attaching said crotch-cradling panel between said frame and said movable closure bar includes means for varying the length of said crotch-cradling panel to thereby adjust the distance to which said panel drapes downwardly between said frame and said closure bar.

9. The combination according to claim 8 wherein said elongated crotch-cradling panel is wide adjacent the end thereof attached to said closure bar than adjacent the end thereof attached to said frame.

10. The combination according to claim 9 further including means for adjusting the length of said legs.

11. The combination according to claim 10 wherein said closure bar and said crotch-cradling panel may be completely removed from said frame when said walker is to be used by persons with lesser degrees of disability.

12. The combination according to claim 11 wherein cushion means are provided on said frame on the upper portion thereof on both sides and in front of a person using the walker.

13. The combination according to claim 1 wherein said frame comprises three sides of a rectangle, and is horizontally oriented when said wlaker is in use.

14. The combination according to claim 13 wherein said closure bar is removably attached to the open fourth side of said rectangle.

15. The combination according to claim 1 wherein said crotch-cradling panel is attached at its forward end to said frame and at its rearward end to said closure bar.

16. The combination according to claim 15 wherein the manner of attaching said crotch-cradling panel between said frame and said movable closure bar includes means for varying the length of said crotch-cradling panel to thereby adjust the distance to which said panel drapes downwardly between said frame and said closure bar.

17. The combination according to claim 1 wherein said elongated crotch-cradling panel is wider adjacent one end thereof than adjacent the other end thereof.

18. The combination according to claim 17 wherein said crotch-cradling panel is attached at said one end thereof to said closure bar and is attached at said other end thereof to said frame diametrically opposite said closure bar; and the manner of attaching said crotch-cradling panel between said frame and said movable closure bar includes means for varying the length of said crotch-cradling panel to thereby adjust the distance to which said panel drapes downwardly between said frame and said closure bar.

19. The combination according to claim 1 further including means for adjusting the length of said legs.

20. The combination according to claim 19 wherein a caster is attached to the lower end of each of said legs.

21. The combination according to claim 20 wherein said casters are removably attached to the lower ends of said legs.

22. The combination according to claim 20 wherein said casters are retractably attached to the lower end of said legs.

23. The combination according to claim 20 wherein said closure bar and said crotch-cradling panel may be completely removed from said frame when said walker is to be used by persons with lesser degrees of disability.

* * * * *